United States Patent [19]

Hogue et al.

[11] 4,004,264

[45] Jan. 18, 1977

[54] VARIABLE RESISTANCE DEVICE

[75] Inventors: Ronald P. Hogue, Rowland Heights; Robert D. Hill, Jr., Santa Ana; Paul F. Gerwitz, West Covina, all of Calif.

[73] Assignee: Carrier Corporation, Syracuse, N.Y.

[22] Filed: Mar. 17, 1975

[21] Appl. No.: 559,282

[52] U.S. Cl. ..... 338/174; 338/162; 338/164; 338/184

[51] Int. Cl.[2] ..... H01C 10/30

[58] Field of Search ..... 338/118, 160, 162, 164, 338/170, 174, 180, 184, 190

[56] References Cited

UNITED STATES PATENTS.

| | | | |
|---|---|---|---|
| 3,115,614 | 12/1963 | Habereder | 338/174 |
| 3,242,452 | 3/1966 | Grundwald et al. | 338/174 |

*Primary Examiner*—C. L. Albritton
*Attorney, Agent, or Firm*—J. Raymond Curtin; Barry E. Deutsch

[57] ABSTRACT

A variable resistance device of the type wherein a worm screw is utilized to move a contact bearing member through a path of travel relative to conductive and resistive tracks. The variable resistor includes a ratchet member having a single elongated spring section attached to a body portion. The body portion has two rigid legs extending therefrom. The spring portion of the ratchet member is disposed within a groove formed in a surface of the contact bearing member. The rigid legs of the ratchet member are the sole elements in contact with the worm screw when the contact member reaches the end of its travel relative to the resistive and conductive tracks.

9 Claims, 6 Drawing Figures

VARIABLE RESISTANCE DEVICE

BACKGROUND OF THE INVENTION

The present invention relates to the field of multi-turn variable resistance devices, and more particularly, to a ratcheting mechanism for multi-turn variable resistance devices employing a worm screw.

Multi-turn variable resistors having a lead or worm screw adjusting mechanism are employed in many varied applications. Very often, such resistors are used in applications where they are adjusted infrequently after the circuit has been initially adjusted or "trimmed."

When readjustment of the resistors is required, the resistors are generally designed so that one turn of the lead or worm screw rotates the contact member only a short distance relative to the conductive and resistive tracks of the variable resistor. Accordingly, if a major readjustment of the resistance device is required, the lead screw must be rotated through many turns in order to obtain the desired new resistance value.

Typically, variable resistors of the type described, are generally of relatively small size whereby the size and strength of the individual components of the device are necessarily reduced and therefore are more susceptible to damage. Adjustment of the resistance via rotation of the worm screw is generally accomplished by the use of a screwdriver or similar tool.

Very often, the resistive and conductive tracks are arcuate and the contact bearing member is rotated relative thereto when the desired readjustment of the resistance device is required. Although the conductive and resistive tracks are generally arcuate, they typically do not comprise a complete circle, but rather comprise a major sector thereof, for example 320°.

For this reason, stop means are employed to limit rotation of the contact bearing member at either end of the resistive and conductive tracks.

In the absence of clutch mechanisms, the only indication that an operator receives when the contact bearing member has reached the end of its travel would be a sudden increase in the torque required to turn the worm screw. This might happen quite abruptly and if the operator were not expecting same, he might apply an excessive amount of torque to the worm screw whereby damage to the stops and/or gear teeth of the contact bearing member and worm screw might occur.

Accordingly, to prevent the foregoing damage, clutch mechanisms of various types are employed to disengage the lead screw when the contact member reaches the end of its travel. To prevent damage from occurring to the various elements of the variable resistor, it is essential that such clutch mechanisms be highly reliable in operation and of long lasting design.

Examples of prior art clutch mechanisms are disclosed in U.S. Pat. Nos. 3,115,614; 3,179,910; 3,242,452; and 3,768,325. The mechanisms employed in U.S. Pat. Nos. 3,115,614 and 3,242,452 utilize a ratcheting mechanism in which a portion of the teeth of a worm gear have been omitted to form a blank area. A member having two resilient, relatively short strips is located in the blank area to engage the threads of the worm screw when the worm gear teeth are rotated out of engagement with the threads of the screw. At this time, further rotation of the worm gear is prevented by means of stop means. The disadvantage of such a clutch mechanism involves the use of the relatively short resilient strip members which, after repeated usage, may become over-stressed and thereby break.

The clutch mechanisms disclosed in U.S. Pat. Nos. 3,179,910 and 3,768,325 employ a resilient stop whereby a worm gear bearing the contact member is caused to oscillate when the contact member reaches either end of the resistive and conductive tracks. If minute particles of dirt or other fine material are on either the resistive track or the contact member, electrical noise will be generated as the gear and contact member are oscillated.

SUMMARY OF THE INVENTION

An object of the invention is an improved ratchet mechanism for a multi-turn variable resistor device.

Another object of the present invention is a ratcheting mechanism which is simple and inexpensive to manufacture and assemble, yet is highly reliable in operation.

It is a further object of the present invention to maintain the contact member stationary when the member reaches the end of its travel.

These and other objects of the present invention are obtained in a multi-turn variable resistance device having a lead screw operably connected to a contact bearing member having a plurality of gear teeth engaged with the threads of the lead screw. A contact is connected to the contact bearing member so that rotation of the member causes the contact to similarly move in a defined path of travel. The contact bearing member further has an elongated groove formed on a first surface thereof. A ratchet mechanism includes a single elongated resilient member attached to a body portion having two rigid, outwardly extending legs. The single resilient member is placed within the groove formed in the surface of the contact bearing member. One of the legs of the ratchet mechanism is the sole element in engagement with the threads of the lead screw when the contact reaches one end of the resistive and conductive tracks. The other leg of the ratchet mechanism is the only element engaged with the threads of the lead screw when the contact reaches the other end of the resistive and conductive tracks.

DESCRIPTION OF THE PREFERRED EMBODIMENT

Figure 1:
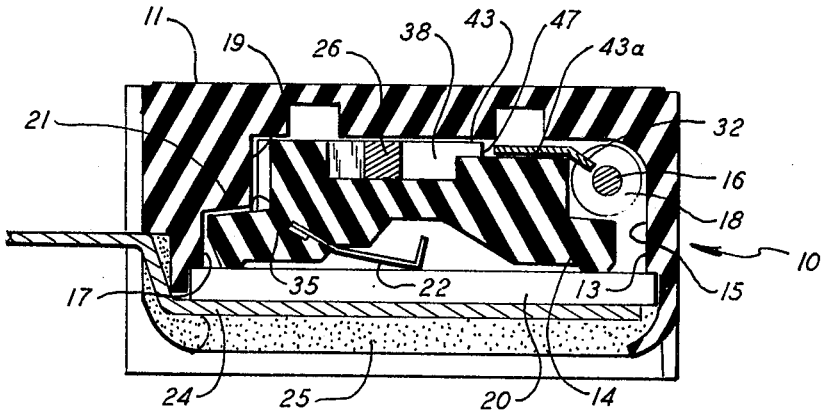
FIG. 1 is a vertical sectional view of a resistance device taken along line I—I of FIG. 5.

Referring now to the drawings, there is shown a preferred embodiment of the present invention as utilized in a multi-turn variable resistance device. In referring to the various figures of the drawings, like numerals shall refer to like parts.

Variable resistance device 10 includes a housing 11 formed in the shape of a square and being of non-conductive material. It should be understood that other geometric configurations may be employed in lieu of the square shape illustrated. Housing 11 has a bore 13 provided therein in which a rotatable contact bearing member 14 is disposed. Bore 13 is defined by sidewalls 15, 17, and 19, walls 17 and 19 defining therebetween a shoulder 21.

Device 10 includes a rotatable contact bearing member 14, preferably formed from a non-conductive material such as plastic, and comprising a first generally cylindrical portion 36 and a second somewhat smaller cylindrical portion 34. Cylindrical portions 34 and 36 define therebetween a flange 35. As shown in FIG. 1, flange 35 is disposed beneath shoulder 21 when contact bearing member 14 is placed within bore 13.

Second cylindrical portion 34 has a plurality of gear teeth 50 extending from the sides thereof. Sector 37 bounded by gear teeth 39 and 41 is devoid of gear teeth. A stop member 40 projects upwardly from the top surface of cylindrical portion 34 of contact bearing member 14. A suitable contact member 22, shown in FIG. 1, is attached to the under surface of contact bearing member 14. As is known in the art, contact member 22 moves along the surface of conductive and resistive tracks respectively 52 and 54 (shown in FIG. 6) as contact bearing member 14 is rotated in a manner to be described hereinafter.

Upper surface 43 of contact bearing member 14 has an elongated groove 38 formed therein. Essentially, groove 38 extends along a diametrical line drawn in a horizontal plane through cylindrical portion 34. Preferably groove 38 bi-sects sector 37. Groove 38 is provided for a reason to be more fully explained hereinafter.

Figure 6:
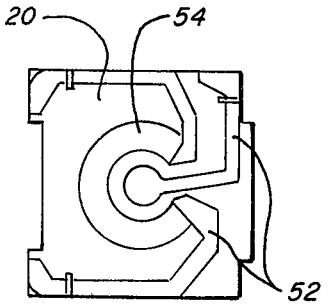
FIG. 6 is a plan view of a substrate member having suitable conductive and resistive tracks.
Figure 2:
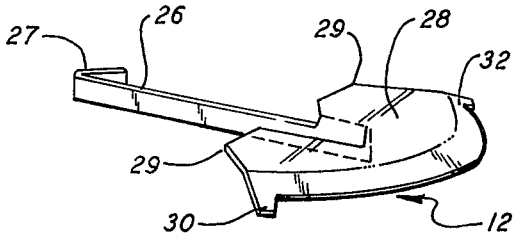
FIG. 2 is a perspective view of a ratchet mechanism of the present invention.

A non-conductive substrate member 20 closes off the open end of bore 13. As shown in FIG. 6, the surface of member 20 engaged by contact member 22 has suitable conductive and resistive tracks 52 and 54 formed thereon. Preferably, the conductive and resistive tracks are provided in an arcuate shape, although other geometric configurations may be suitably employed. Terminal pins, for example pin 24, are suitably affixed to the end of the conductive and resistive tracks in a manner well known to those skilled in the art. Epoxy 25 or similar material is provided to seal substrate 20 to housing 11 to prevent ingress of foreign matter.

A lead or worm screw 16 is provided in an orifice 46 formed in a sidewall 48 of housing 11. Lead screw 16 includes a portion having a helically formed thread 18. Head 45 of lead screw 16 includes an opening 44 for receiving a tool such as a screwdriver whereby an operator may rotate the lead screw. Gear teeth 50 of contact bearing member 14 are generally operatively engaged with thread 18 whereby rotation of worm screw 16 will cause member 14 to similarly rotate. The rotational movement of member 14 will cause contact member 22 to move along the conductive and resistive tracks when the resistance device is being adjusted to a desired value.

Figure 4:
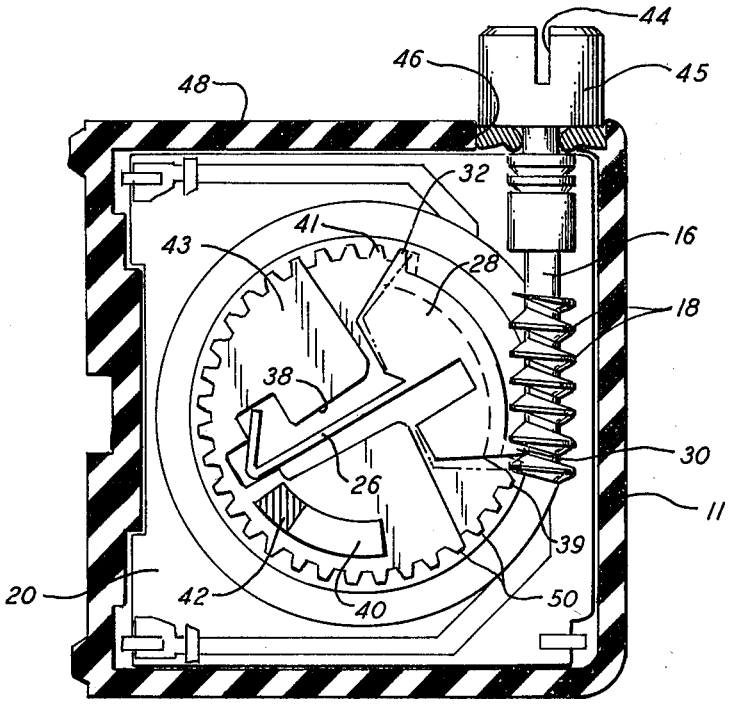
FIG. 4 is a sectional view illustrating the contact at one end of its path of travel.

Housing 11 includes a stop member 42 (shown in FIGS. 4 and 5) provided to engage stop member 40 of contact bearing member 14 when the contact member has been moved to either end of the resistive and conductive tracks. Preferably, stop member 42 extends downwardly from the top surface of housing 11. As illustrated in FIG. 4, contact bearing member 14 has been rotated in a maximum clockwise direction, whereas as illustrated in FIG. 5, the contact bearing member has been rotated in a maximum counter-clockwise direction.

Sidewalls 17 and 19 and the engagement of thread 18 with gear teeth 50 prevent any undesired movement of contact bearing member 14 in a horizontal plane when the member is placed in bore 13.

Device 10 further includes a ratchet device 12. Ratchet device 12 includes a single, elongated spring member 26 attached to a body portion 28. Body portion 28 includes two rigid legs 30 and 32 extending outwardly therefrom.

Figure 3:
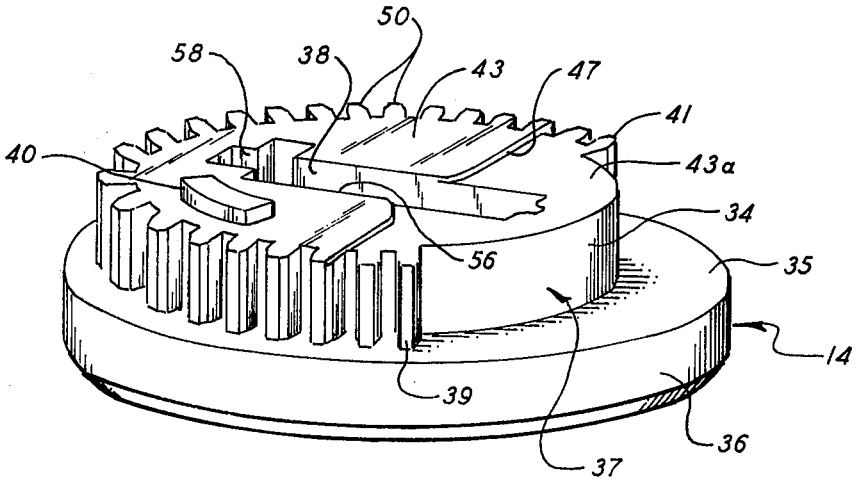
FIG. 3 is a perspective view of a contact bearing member in accordance with the present invention.
Figure 5:
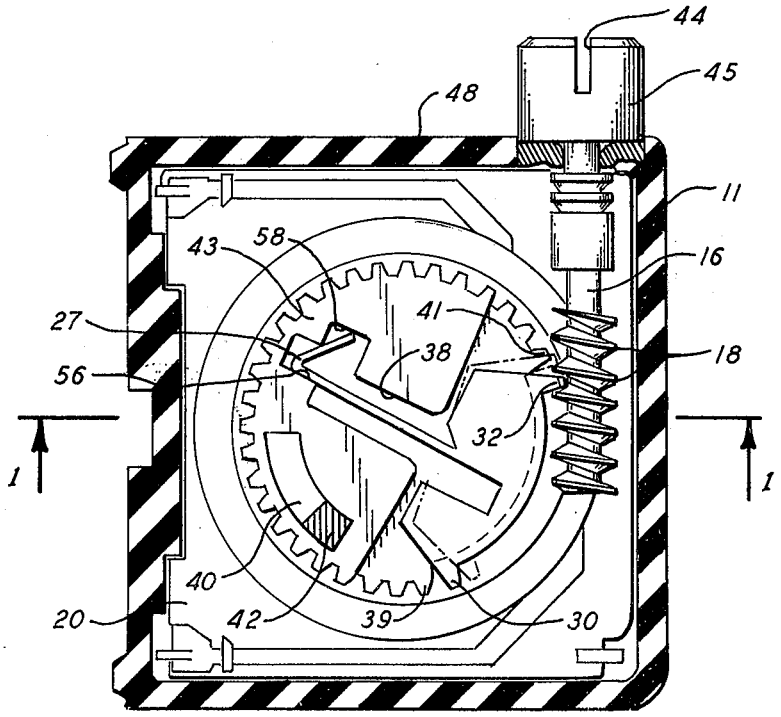
FIG. 5 is a sectional view showing the contact at its other end of its path of travel.

As is illustrated in FIGS. 4 and 5, ratchet device 12 is mounted for rotation with member 14. Elongated spring member 26 is placed within groove 38 whereby hooked-end portion 27 of spring member 26 is trapped between opposed side walls 56 and 58 of groove 38. Body portion 28 is disposed on surface **43*a* to overlay sector 37 such that rigid leg 30 is adjacent gear tooth 39 and leg 32 is adjacent tooth 41. Surface 43*a* is stepped slightly below surface 43 to accommodate ratchet device 12. A vertical surface 47, shown in FIGS. 1 and 3, is defined by the stepped relationship between surfaces 43 and 43*a*. As shown in FIGS. 4 and 5, spring member 26 does not fit snugly within groove 38 for its entire length; accordingly, relative movement between ratchet member 12 and contact bearing member 14 may occur if the ratchet member is subjected to a force and the contact bearing member is maintained stationary. Body portion 28 includes two generally flat drive faces 29 generally aligned with vertical surface 47.**

In operation, when it is desired to change the value of resistance device 10, an operator places a tool such as a screwdriver into groove 44 of shaft 16. Shaft 16 is rotated, whereby due to the engagement of thread 18 with gear teeth 50, contact bearing member 14 is similarly moved. As contact member 22 reaches one end of resistive and conductive tracks 54 and 52, stop member 40 moves into engagement with stationary stop 42. As noted previously, FIG. 4 illustrates the engagement of the stop members when contact member 22 reaches the ends of the tracks and member 14 has been rotated in a clockwise direction. When the stop members are so engaged, none of gear teeth 50 are in contact with thread 18 of lead screw 16. As clearly shown in FIG. 4, only upstanding rigid leg 30 of ratchet member 12 is engaged at such time with thread 18.

Continued rotation of lead screw 16 will cause the ratchet member to oscillate relative to the contact bearing member 14. The force provided by spring member 26 produces the oscillating movement of member 12. In effect, rigid leg 30 snaps over threads 18 upon continued rotation of screw 16.

When the direction of rotation of screw 16 is reversed, drive faces 29 of ratchet device 12 engage vertical surface 47 of contact bearing member 14 to cause tooth 39 to reengage thread 18. In effect the foregoing action provides a direct drive between screw 16 and member 14. This direct drive, in addition to the force provided by spring 26, insures that gear teeth 50 will reengage with thread 18 when reverse rotation of member 14 is desired.

If the contact bearing member is rotated a maximum amount in a counter-clockwise direction so the stop members are engaged in the manner shown in FIG. 5, member 12 will undergo a similar oscillating movement. However, in this case, rigid leg 32 is the only element in contact or engagement with threads 18.

FIG. 5 illustrates this condition. When it is again desired to reverse rotation, faces 29 of device 12 will reengage surface 47 in the manner described above.

The present invention involves a relatively inexpensive but highly reliable ratchet member whereby damage to the moving parts of a resistance device is prevented. Groove 38 may be readily formed during the molding of member 14. Ratchet member 12 may be readily and inexpensively made from stamped pieces.

By providing a relatively long spring member, the spring member will not be severely stressed when contact member 22 reaches either ends of the resistive and conductive tracks. A long spring will have much less localized stress when compared to the stress induced in a short spring when both springs are subjected to the same forces. In addition, by maintaining the contact bearing member stationary when the contact member is at either end of the resistive track, no electrical noise will be generated.

It should be understood, if contact bearing member were permitted to rotate slightly less than 360° in either direction, rigid legs 30 and 32 might be replaced by a single leg directly aligned with spring member 26. Such a construction should be considered an equivalent of the specific structure disclosed and claimed herein.

While a preferred embodiment of the present invention has been described and illustrated, the invention should not be limited thereto, but may be otherwise embodied within the scope of the following claims.

We claim:

1. A variable resistor comprising:

a housing;

a substrate member of non-conductive material supported by the housing, said substrate member having a conductive track and a resistive track disposed on a first surface thereof;

movable contact means electrically connecting said resistive and conductive tracks, said contact means including a gear having a sector devoid of gear teeth, said contact means further having a groove formed on a surface thereof remote from said substrate member and disposed substantially parallel thereto;

a worm screw having a helically formed thread in engagement with said gear of said contact means, rotation of said screw causing said contact means to move along the conductive and resistive tracks;

stop means having a first portion connected to said contact means and movable therewith and a second portion connected to a fixed section of said variable resistor, said first and second portions, engaging to prevent further movement of said contact means in the same direction as the contact means approaches the ends of the conductive and resistive tracks; and a ratchet member including a single elongated spring attached to a body portion, said body portion having two rigid legs extending therefrom, said spring being disposed within said groove formed in said remote surface of said contact means, said rigid legs being disposed within the sector of said gear, each of said legs being disposed adjacent a gear tooth defining the boundary of said sector, one of said legs being the sole element in engagement with the threads of said worm screw when said contact means reaches the end of its travel in a first direction, and the other of said legs being the sole element in engagement with the threads of said worm screw when said contact means reaches the end of its travel in a second direction.

2. A variable resistor in accordance with claim 1 wherein said groove is formed substantially about a line defining a diameter extending through the surface of said contact means, said spring of said ratchet member extending substantially the entire length of said groove.

3. A variable resistor in accordance with claim 2 wherein said contact means is stationary and said ratchet member moves relative thereto when either of the legs is the sole element in engagement with said worm screw.

4. A variable resistor in accordance with claim 1, wherein said contact means is stationary and said ratchet member moves relative thereto when either of the legs is the sole element in engagement with said worm screw.

5. In a multi-turn variable resistor of the type having a worm screw operably connected to a gear sector of a contact bearing member, the improvement comprising:

means defining a groove formed about a line defining a diameter extending through a generally planar surface of the contact bearing member; and a ratchet member including a single, elongated spring attached to a body portion, said body portion having two rigid legs extending therefrom, said spring being disposed within said groove formed in said planar surface of said contact bearing member, one of said legs being the sole element in engagement with the worm screw when said contact bearing member has moved a maximum distance in a first direction; and the other of said legs being the sole element in engagement with the worm screw when said contact bearing member has moved a maximum distance in a second direction.

6. A variable resistor comprising:

a housing;

a substrate member of non-conductive material supported by the housing, said substrate member having a conductive track and a resistive track disposed on a first surface thereof;

movable contact means electrically connecting said resistive and conductive tracks, said contact means including a gear having a sector devoid of gear teeth, said contact means further having a groove formed on a surface thereof remote from said substrate member and disposed substantially parallel thereto;

a worm screw having a helically formed thread in engagement with said gear of said contact means, rotation of said screw causing said contact means to move along the conductive and resistive tracks;

stop means having a first portion connected to said contact means and movable therewith and a second portion connected to a fixed section of said variable resistor, said first and second portions engaging to prevent further movement of said contact means in the same direction as the contact means approaches the ends of the conductive and resistive tracks; and a ratchet member including a single elongated spring attached to a body portion, said body portion having two rigid legs extending therefrom, and two substantially flat faces extending in a direction opposite to the rigid legs, said spring being disposed within said groove formed in said remote surface of said contact means, said body portion overlying a surface of said contact means stepped below said remote surface to define therebetween a vertical surface, said rigid legs being disposed within the sector of said gear, each of said legs being disposed adjacent a gear tooth defining the boundary of said sector, one of said legs being the sole element in engagement with the threads of said worm screw when said contact means reaches the end of its travel in a first direction, and the other of said legs being the sole element in engagement with the threads of said worm screw when said contact means reaches the end of its travel in a second direction, the flat faces of said body portion of said ratchet member being forced into engagement with the vertical surface of said contact means to provide a direct drive between said worm screw and said contact means when said contact means is at one end of its travel and said worm screw is rotated in an opposite direction.

7. A variable resistor in accordance with claim 6, wherein said groove is formed substantially about a line defining a diameter extending through the surface of said contact means, said spring of said ratchet member extending substantially the entire length of said groove.

8. A variable resistor in accordance with claim 7, wherein said contact means is stationary and said ratchet member moves relative thereto when either of the legs is the sole element in engagement with said worm screw.

9. A variable resistor in accordance with claim 6, wherein said contact means is stationary and said ratchet member moves relative thereto when either of the legs is the sole element in engagement with said worm screw.

* * * * *

UNITED STATES PATENT OFFICE
CERTIFICATE OF CORRECTION

PATENT NO. : 4,004,264

DATED : January 18, 1977

INVENTOR(S) : Ronald P. Hogue, Robert D. Hill, Jr., & Paul F. Gerwitz

It is certified that error appears in the above-identified patent and that said Letters Patent are hereby corrected as shown below:

First Page of Patent

[73] Assignee: should read --SPECTROL ELECTRONICS CORPORATION
CITY OF INDUSTRY. CALIF.--

Signed and Sealed this

*Thirty-first* Day of *October 1978*

[SEAL]

*Attest:*

RUTH C. MASON
*Attesting Officer*

DONALD W. BANNER
*Commissioner of Patents and Trademarks*